US005718129A

United States Patent [19]

Makiyama et al.

[11] Patent Number: 5,718,129

[45] Date of Patent: Feb. 17, 1998

[54] KNIT PILE MADE FROM CATION DYEABLE POLYESTER AND ACRYLIC FIBERS

[75] Inventors: Muneto Makiyama, Kobe; Yoshitomo Matsumoto, Takasago, both of Japan

[73] Assignee: Kanegafuchi Kagaku Kogyo Kabushiki Kaisha, Osaka, Japan

[21] Appl. No.: 591,116

[22] Filed: Jan. 25, 1996

[30] Foreign Application Priority Data

Jan. 25, 1995 [JP] Japan ..... 7-009455

[51] Int. Cl.[6] ..... B32B 3/02; D04B 1/04

[52] U.S. Cl. ..... 66/202; 428/85; 428/97; 428/16; 28/159; 139/420 A

[58] Field of Search ..... 428/97, 85, 16, 428/15; 28/159; 66/194, 202; 139/420 A

[56] References Cited

U.S. PATENT DOCUMENTS

| | | | |
|---|---|---|---|
| 4,316,924 | 2/1982 | Minemura et al. | 428/89 |
| 4,332,585 | 6/1982 | Minemura et al. | 428/97 |
| 4,539,242 | 9/1985 | Sasaki et al. | 428/92 |
| 5,512,059 | 4/1996 | Ido et al. | 8/115.7 |
| 5,516,436 | 5/1996 | Uchida et al. | 252/8.6 |

FOREIGN PATENT DOCUMENTS

| | | | |
|---|---|---|---|
| 6-81248 | 3/1994 | Japan | 139/420 A |

*Primary Examiner*—Andy Falik

*Attorney, Agent, or Firm*—Armstrong, Westerman, Hattori, McLeLand & Naughton

[57] ABSTRACT

A pile composition containing: from 20 to 60% by weight of synthetic fibers containing a polyester copolymer containing sulfonic groups, which can be dyed with a cationic dye, and from 40 to 80% by weight of synthetic fibers containing at least one of acrylic fibers and modacrylic fibers.

3 Claims, No Drawings

KNIT PILE MADE FROM CATION DYEABLE POLYESTER AND ACRYLIC FIBERS

FIELD OF THE INVENTION

The present invention relates to a pile composition which is excellent in soft feeling, elasticity and wrinkle resistance, and is mainly used as an artificial fur.

BACKGROUND OF THE INVENTION

Natural fur is composed of a two layer structure of bristles which are called guard hairs, and flocci which are called down hairs, has excellent characteristics in feeling, appearance and functionality, and is mainly used as clothing such as overcoats. For example, a fur of beaver is constituted of guard hairs and down hairs, but in the practical use thereof, the guard hairs ate conventionally shorn, and only the down hairs are used. Further, taking mink as an example, the fur thereof is made up of fine and short down hairs that occupy about 70 to 80% of the fur, and thick and long guard hairs that occupy about 20 to 30% of the fur, and the down hairs support the guard hairs, thereby showing a raised state and also assisting blooming property. Further, such a two layer structure composed of the down hairs and the guard hairs gives provides a hue effect and soft feeling.

Of various functionalities, natural furs are excellent in heat insulating property, water repellency, snow repellency, wrinkle resistance, wrinkle recovery, and the like. It is considered that those excellent properties are due to the characteristics originating from single fibers, and the structure of the fur. Conventionally, in order to improvee products so that they approach to the above-described characteristics of the natural fur, extensive studies have been made on materials for pile, and knitting and weaving techniques. A pile composition mainly comprises a base fabric and a pile, and a woven pile method, a knitting bore method, a sliver knit method, Russell method, a needle punch non-woven fabric method, and the like are known as a production methods of the pile products. Further, synthetic fibers that mainly include modacrylic fibers are mainly used as materials for the pile. For example, where artificial fur is produced by a sliver knit method, the artificial fur is generally produced by mixing at least two kinds of fine and short fibers in order to express a raised state of the natural fur. However, in such a pile composition obtained above, although soft feeling and smoothness are obtained, elasticity and wrinkle resistance are poor as compared with the natural fur.

SUMMARY OF THE INVENTION

As a result of extensive studies on the constituent of pile materials, it has been found that a pile composition having excellent various properties can be obtained by using specific synthetic fibers. The present invention is completed based on this finding.

Accordingly, an object of the present invention is to provide a novel pile composition having excellent soft feeling, elasticity and wrinkle resistance.

The pile composition according to the present invention comprises synthetic fibers comprising a polyester copolymer having sulfonic groups, and synthetic fibers comprising at least one of acrylic fibers and modacrylic fibers.

In the preferred embodiment, the synthetic fibers comprising the polyester copolymer. are synthetic fibers comprising a polyester copolymer having sulfonic groups which can be dyed with a cationic

DETAILED DESCRIPTION OF THE INVENTION

Cation dyeable polyester fibers (hereinafter referred to as "CDPET fibers" for brevity) comprising the polyester copolymer containing sulfonic groups, which can be dyed with a cationic dye, contain an isophthalic acid component containing a sulfonic acid metal base in an amount of from 0.03 to 3.0 mol % per mole of the polyester, and can clearly be dyed in dark tone with a cationic dye at a temperature of about 100° C. under ordinary pressure without using a carrier.

The CDPET fibers have a fineness of from 1 to 7 deniers (hereinafter referred to as "d" for brevity), and a fiber length of from 25 to 50 mm. A cross-sectional shape of the fiber is selected from a flattened form, an ellipse form, a three or four circle-continued form, a trefoil form, a four-leaf form, and the like. Further, in order to adjust the luster of the fiber surface, titanium oxide and the like can be added to the CDPET fibers. In addition, in order to obtain soft feeling, the fibers can also be treated with a cationic flexibilizer, an amino- or epoxy-modified silicone, or the like.

The acrylic fibers and modacrylic fibers have a fineness of from 5 to 30 d, and a fiber length of from 32 to 89 mm. A cross-sectional shape of the fibers is selected from a circle form, a kidney form, a flattened form, an ellipse form, a trefoil form, a four-leaf form, and the like. Further, in order to obtain soft feeling, it is preferred that the surface of the fibers is modified, or the fibers are subjected to a permanent flexibilizing treatment.

The pile materials such as CDPET fibers, acrylic fibers, modacrylic fibers, and the like as described above, which can be used in the present invention, are selected from raw fiber, solution dyed fiber and dyed fiber. Further, the luster of those pile materials can freely be selected from dull type and bright type.

The pile composition according to the present invention comprises from 20 to 60% by weight of the CDPET fibers, and from 40 to 80% by weight of the synthetic fibers comprising at least one of acrylic fibers and the modacrylic fibers. It is preferred that the amount of the CDPET fibers is from 30 to 50% by weight.

Next, a method of producing the pile composition according to the present invention is explained below. The pile materials such as CDPET fibers, acrylic fibers, modacrylic fibers, and the like are first uniformly mixed. The resulting mixture is passed through a card to prepare slivers. Succeedingly, the slivers thus obtained are knitted into a base fabric using a sliver knitting machine. After undergoing polishing, shearing, and coating processes, the base fabric is subjected to a combination of polishing, shearing, and brushing processes, and a shearing is finally conducted, whereby the pile composition according to the present invention can be obtained.

As described above, the pile composition according to the present invention comprises the CDPET fibers, and fibers containing acrylonitrile such as acrylic fibers, modacrylic fibers, and the like, and has a soft feeling like a natural fur, and is excellent in elasticity and wrinkle resistance. It is considered that this soft feeling is due to a mixing of the CDPET fibers with the acrylic fibers, and/or the modacrylic fibers. Further, it is considered that the excellent elasticity is due to the fact that in finish processing the pile, the amount of residual crimps are large compared with the modacrylic fibers or the acrylic fibers due to thermal characteristics of the CDPET fibers, and also due to a Young's modulus which is possessed by single fibers. Furthermore, it is considered that the excellent wrinkle resistance due to the fact that judging from a stress-strain curve of the CDPET fibers, the strain that relates to wrinkles is 10 to 15%, so that permanent strain is less.

Prior to describing the examples, evaluation methods of the performances of the pile compositions are described below. Regarding the pile performances, soft feeling and elasticity were evaluated on the manufactured pile compositions by five intellectual judges from visual and tactile standpoints. Further, the wrinkle resistancewas evaluated with the grades of from grade 1 to grade 5 according to AATCC-128. The grade 4 or more are excellent in the wrinkle resistance.

The present invention is described in more detail with reference to the examples, but it should be understood that the invention is not construed as being limited thereto.

EXAMPLE 1

CDPET fibers having a flattened cross-section, a fineness of 3 d, and a fiber length Of 32 mm, and containing 5-sodium sulfoisophthalic acid component in an amount of 3 mol % per mole of a polyester were dyed with a cationic dye in dark brown. 40% by weight of the CDPET fibers thus obtained and 60% by weight of modacrylic fibers having a kidney cross-section, a fineness of 5 d, and a fiber length of 32 mm, which were solution-dyed in dark brown, were sufficiently fiber-blended, to thereby obtain a sliver having a basis weight of 18 g/m. Using double foundation yarns of polyester filaments (150 d), a pile fabric was prepared with a sliver knitting machine. After conducting a pre-polishing and a pre-shearing, and making the pile length constant, an acrylic acid ester adhesive was coated on the back surface of the pile. Thereafter, a polishing at 155° C. and a brushing were conducted, and a polishing at an intermediate temperature (120° C.) and a low temperature (90 ° C.) were conducted, then a shearing was conducted to make finishing, whereby a beaver-like high pile having a pile length of 12 mm was obtained.

EXAMPLE 2

CDPET fibers having a flattened cross-section, a fineness of 3 d and a fiber length of 32 mm, and containing a 5-sodium sulfoisophthalic acid component in an amount of 3 mol % per mole of a polyester were dyed with a cationic dye in navy blue. 30% by weight of the CDPET fibers thus obtained and 70% by weight of modacrylic fibers (KANECARON AH, a trade name, manufactured by Kanegafuchi Chemical Industry Co., Ltd. ) having a kidney cross-section, a fineness of 3 d, and a fiber length of 32 mm, which were solution-dyed in navy blue were used, and a beaver-like high pile was obtained in the same manner as in Example 1.

COMPARATIVE EXAMPLE 1

Using 40% by weight of acrylic fibers having a circular cross-section, a fineness of 3 d, and a fiber length of 32 mm, which were dyed in black, and 60% by weight of acrylic fibers having a flattened cross-section, fineness of 5 d, and a fiber length of 32 mm, which were dyed in black, a beaver-like high pile was obtained in the same manner as in Example 1.

The pile compositions obtained in Examples 1 and 2 and Comparative Example 1 above were evaluated on the performances thereof. The results obtained are shown in the Table 1 below.

TABLE 1

| | Pile Material | Pile Performances | | |
|---|---|---|---|---|
| | | Feeling | Elasticity | Wrinkle resistance |
| Example 1 | CDPET fibers (3d × 32 mm) 40% Dark Brown (flattened form) Modacrylic fibers (5d × 32 mm) 60% Dark Brown (Kidney form) | o | o | Grade 5 |
| Example 2 | CDPET fibers (3d × 32 mm) 30% Navy Blue (flattened form) Modacrylic fibers (3d × 32 mm) 70% Navy Blue (Kidney form) | o | o | Grade 4 |
| Comparative Example 1 | Acrylic fibers (3d × 32 mm) 40% Black (Circular form) Acrylic fibers (5d × 32 mm) 60% Black (flattened form) | x | x | Grade 2 |

O=good

X=No good

As is apparent from the results shown in the Table above, the pile composition according to the present invention is excellent in feeling, elasticity and wrinkle resistance.

What is claimed is:

1. A pile composition comprising:

first synthetic fibers which comprise a polyester copolymer containing sulfonic groups; and second synthetic fibers which comprise at least one of acrylic fibers and modacrylic fibers.

2. The pile composition as claimed in claim 1, wherein the first synthetic fibers are fibers containing sulfonic groups which can be dyed with a cationic dye.

3. The pile composition as claimed in claim 1 or 2, comprising:

from 20 to 60% by weight of the first synthetic fibers; and from 40 to 80% by weight of the second synthetic fibers.

* * * * *